US005306197A

United States Patent [19]

Watanabe

[11] Patent Number: 5,306,197

[45] Date of Patent: Apr. 26, 1994

[54] KEY ACTION, MOVEABLE TOY

[75] Inventor: Hiroyuki Watanabe, Tokyo, Japan

[73] Assignee: Tomy Company, Limited, Tokyo, Japan

[21] Appl. No.: 751,055

[22] Filed: Aug. 28, 1991

[30] Foreign Application Priority Data

Sep. 10, 1990 [JP] Japan ..... 2-239357

[51] Int. Cl.[5] ..... A63H 5/00; A63H 17/00; A63H 29/24

[52] U.S. Cl. ..... 446/409; 446/437; 446/461

[58] Field of Search ..... 446/409, 410, 437, 457, 446/460, 461, 462, 463, 468, 470, 456

[56] References Cited

U.S. PATENT DOCUMENTS

| | | | |
|---|---|---|---|
| 2,642,700 | 6/1953 | Zimmer | 446/468 |
| 2,892,290 | 6/1959 | Ryan | 446/460 X |
| 3,735,527 | 5/1973 | Lombardo | 446/457 |
| 4,152,866 | 5/1979 | Suda | 446/463 |
| 4,274,225 | 6/1981 | Knauff et al. | 446/409 |
| 4,511,343 | 4/1985 | Goldfarb et al. | 446/463 |
| 4,540,380 | 9/1985 | Kennedy et al. | 446/463 |
| 4,565,538 | 1/1986 | Kennedy et al. | 446/462 X |
| 4,573,943 | 3/1986 | Kennedy et al. | 446/463 |
| 4,946,416 | 8/1990 | Stern et al. | 446/219 X |
| 4,964,837 | 10/1990 | Collier | 446/456 X |
| 4,976,650 | 12/1990 | Watanabe | 446/462 X |
| 5,112,267 | 5/1992 | Liu et al. | 446/470 |

FOREIGN PATENT DOCUMENTS

| | | | |
|---|---|---|---|
| 14754 | of 1887 | United Kingdom | 446/409 |
| 1297013 | 6/1969 | Fed. Rep. of Germany | 446/409 |
| 1478564 | 10/1969 | Fed. Rep. of Germany . | |
| 2909523 | 9/1979 | Fed. Rep. of Germany | 446/409 |
| 2108144A | 10/1979 | United Kingdom . | |

OTHER PUBLICATIONS

French Search Report and appendix, search completed Apr. 24, 1992.

*Primary Examiner*—D. Neal Muir
*Attorney, Agent, or Firm*—Staas & Halsey

[57] ABSTRACT

A key action, movable toy of the present invention moves in response to a turning action of a switch key. The toy generates a starting sound and an engine sound. A key switch mechanism which has three positions, off, on and starting, energizes a power unit, which moves the toy, to an on-state. The energizing occurs in response to a switch key moving from the off position to the starting position and to the on position. The power unit will stay on when in the on position, and a sound generation mechanism will switch from the starting sound to an engine sound when the switch key moves to the on position. The toy will move in response to a lever which controls whether the toy will move or stay stationary.

2 Claims, 13 Drawing Sheets 105a
105b
B
A
22a
105c
105
104
105d
104d
106a
OFF

B
A
22a
105
104
104 d
105d
106a
OFF→ON

A
B
22a
105
104
104d
105d
106a
ON→START

A
B
22a
105
104
105d
104d
106a
START→ON

FIG. 10
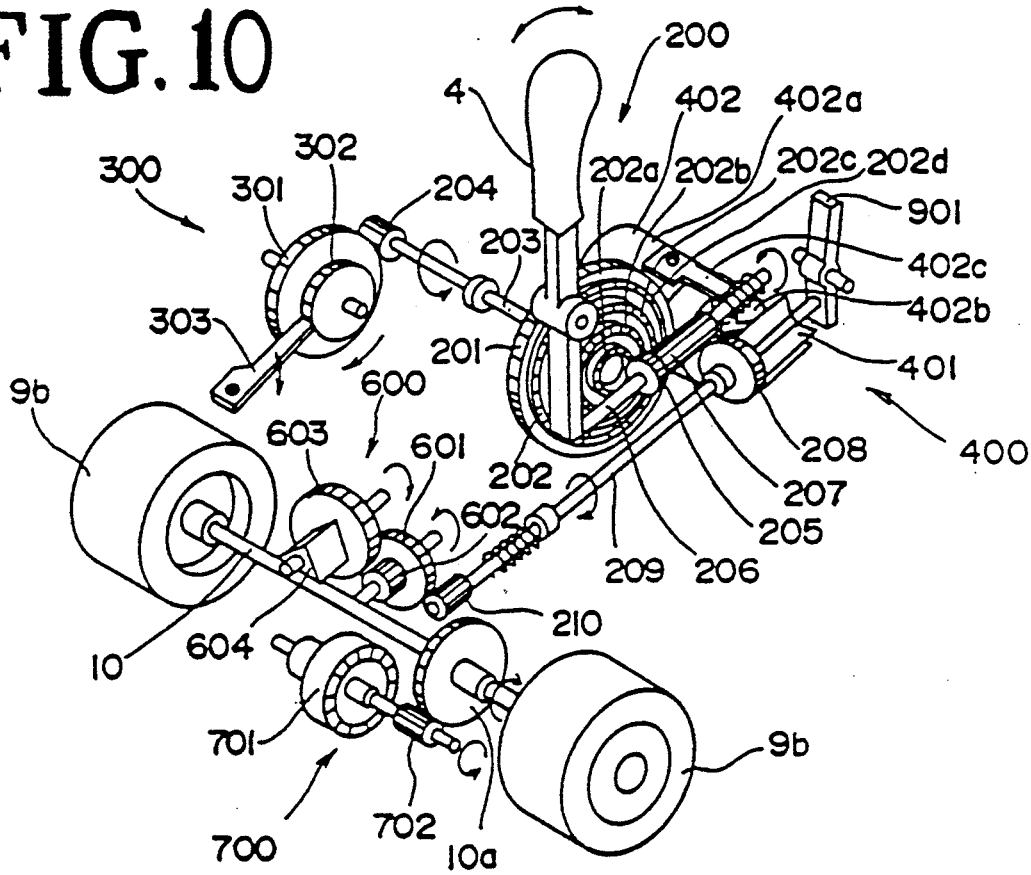
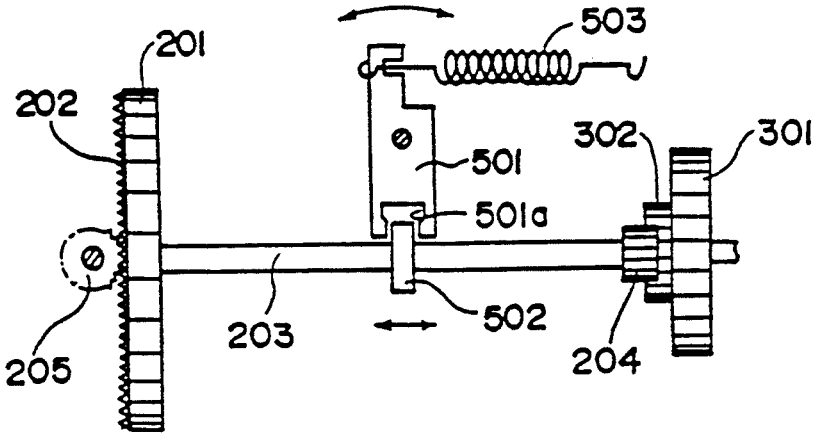
FIG. 11

KEY ACTION, MOVEABLE TOY

BACKGROUND OF THE INVENTION

1. Field of the Invention

This invention relates generally to a moveable toy which can move in response to a turning action of a switch key; and, more particularly to a toy which can selectively generate a starting sound and an engine sound in response to the turning action of a switch key.

2. Description of the Related Art

Conventionally, moveable toys, such as self-propelled automobiles and trucks, are made to imitate various vehicles. A moveable toy is constructed so that wheels are driven by a motor provided in the inside of a body shaped like an automobile to cause the toy to move.

A child who buys a toy of the type mentioned, desires to own a vehicle such as an automobile in the form of a toy and also desires to imitate an adult driving the automobile.

However, the conventionally moveable toy has a problem that it cannot satisfy the desires of the child because the car only has a shape of a vehicle and moves while making a false sound of an engine (hereinafter referred to as an engine sound). The present invention has been made in consideration of the conventional problems described above.

SUMMARY OF THE INVENTION

A main object of the present invention is to provide a self-propelled toy which imitates the operation of an actual vehicle.

A moveable toy of the present invention which moves in response to switch mechanism and a motor (power unit). A starting sound generating mechanism and an engine sound generating mechanism both receive power from the power unit and generate a starting sound and an engine sound, respectively. The switch mechanism which has three positions (on, off and starting) is operated and turned by a switch key. The switch key when turned from the off to on position will not energize the power unit. The switch key must first be turned from the off to starting position to energize the power unit. The switch key when released from the starting position will automatically switch to the on position. In the on position, the motor can immediately move the vehicle or the motor may said idle wherein the car is stationary. A lever is used to select between whether the toy is moving or is stationary.

A sound generating mechanism generates a starting sound in response to switching the switch mechanism from the off position. The second generating mechanism stops generating the starting sound and generates an engine sound when the switch key switches the switch mechanism to the on position.

BRIEF DESCRIPTION OF DRAWINGS

FIG. 10 is a perspective view showing a power mechanism, a starting sound generating mechanism, an engine sound generating mechanism, a rocking mechanism, a running mechanism;

FIG. 11 is a front elevational view of a sound generation mechanism;

DESCRIPTION OF THE PREFERRED EMBODIMENTS

Figure 1:
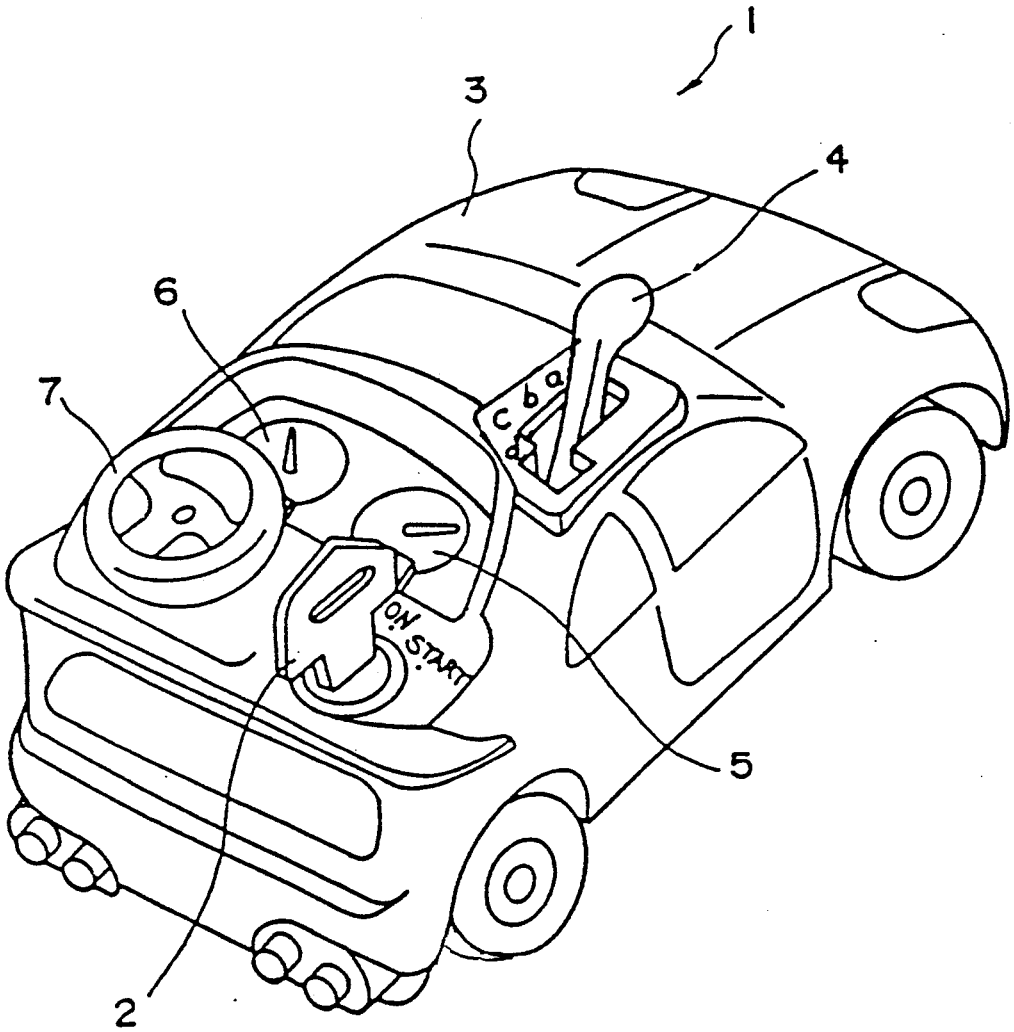
FIG. 1 is a general perspective view showing an embodiment according to the present invention which is shaped like an automobile.

A perspective view of an entire key action, moveable toy 1 according to an embodiment of the present invention is shown in FIG. 1. The toy 1 shown in the present embodiment has an appearance made to imitate an automobile. Operation of the toy is started only after the switch key 2 is operated to turn from an off (OFF) position past on (ON) position to a starting (START) position. A starting sound (a self starter sound of an actual automobile) is also generated simultaneously. If the hand is removed from the switch key 2 subsequently, then the switch key 2 is returned automatically from the starting position to the on position. The starting sound is then changed to an engine sound and the car body 3 bounces upwardly and downwardly. This idle position is possible if shift level 4 is at a position (a). If the shift level 4 is shifted from position (a) to positions (b) and (c), then the engine sounds becomes higher and faster in a stepwise manner and the bouncing motion of the car body 3 becomes smaller and more hasty in a stepwise manner. And, if the shift level 4 is shifted to a position (d), then the engine sound becomes further higher, the bouncing motion of the body 3 disappears and the toy 1 will now move. In response to a shifting operation of the shift level 4, indications of a tachometer 5 and a speedometer 6 are changed. It is also possible to change the running direction of the toy by operating a steering wheel 7.

Figure 2:
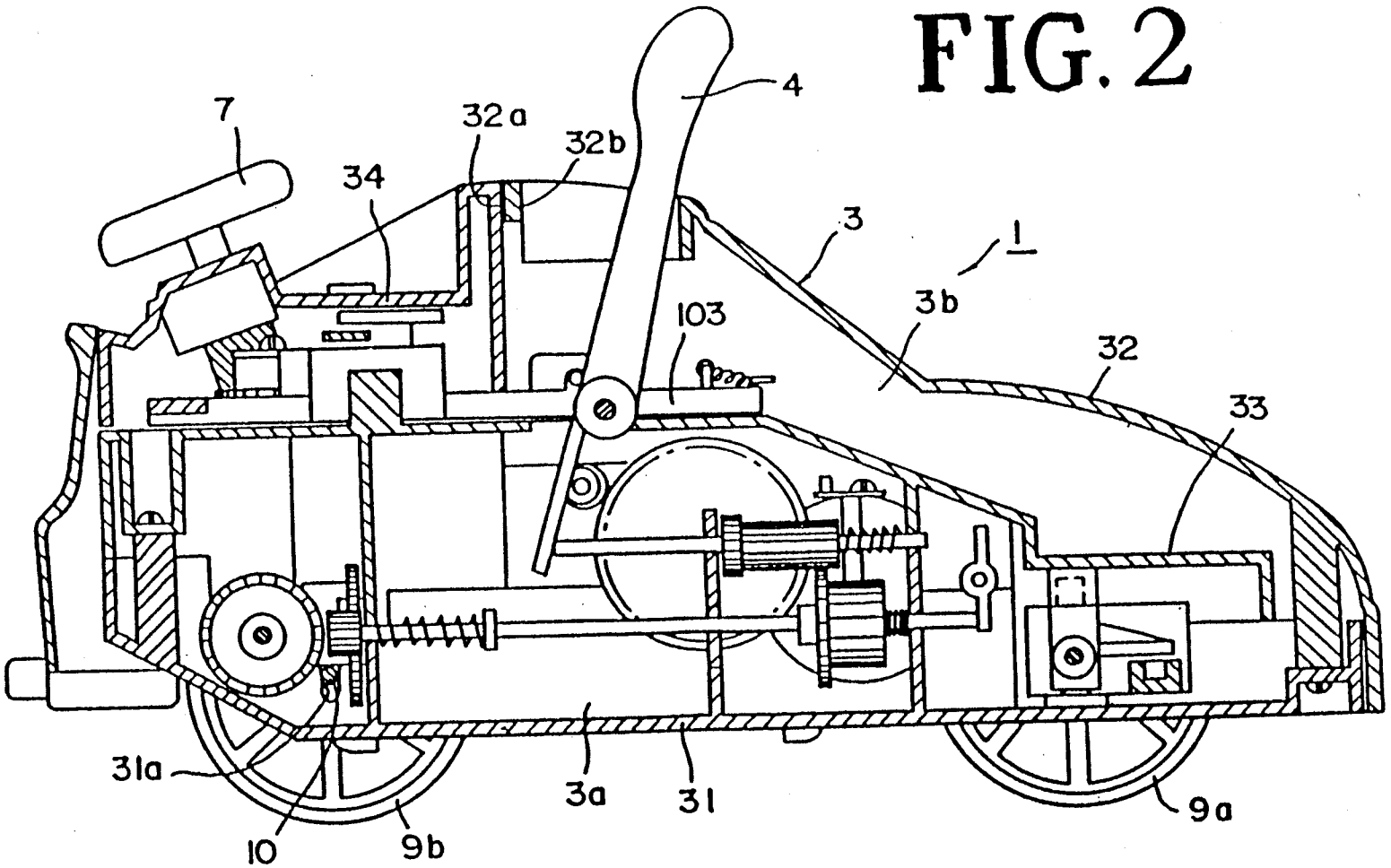
FIG. 2 is a vertical sectional view of the toy of FIG. 1.

The car body 3 comprises, as shown in FIG. 2, a chassis 31 which is a lower part of the car body 3, a cover 32 or a main appearance of an automobile, a machine frame 33 installed in the chassis 31 and cover 32 for partitioning the inside of the car body 3 into a lower chamber 3*a* and an upper chamber 3*b*, and an instrument panel 34 provided in a loaded condition on an upper side of a rear portion of the machine frame 33 and exposed through an opening 32*a* of the cover 32.

Here, front wheels 9*a* and rear wheels 9*b* are provided at front portions and rear portions of side portions of the chassis 31. An axle 10 for the rear wheels 9b is supported and inserted in vertically elongated holes 31a provided in side walls of the chassis 31. An upper end portion of the shift level 4 extends through an opening 32b of a ceiling portion of the cover 32. Meanwhile, the tachometer 5, speedometer 6 and steering wheel 7 are provided on the instrument panel 34 as shown in FIG. 1.

Figure 3:
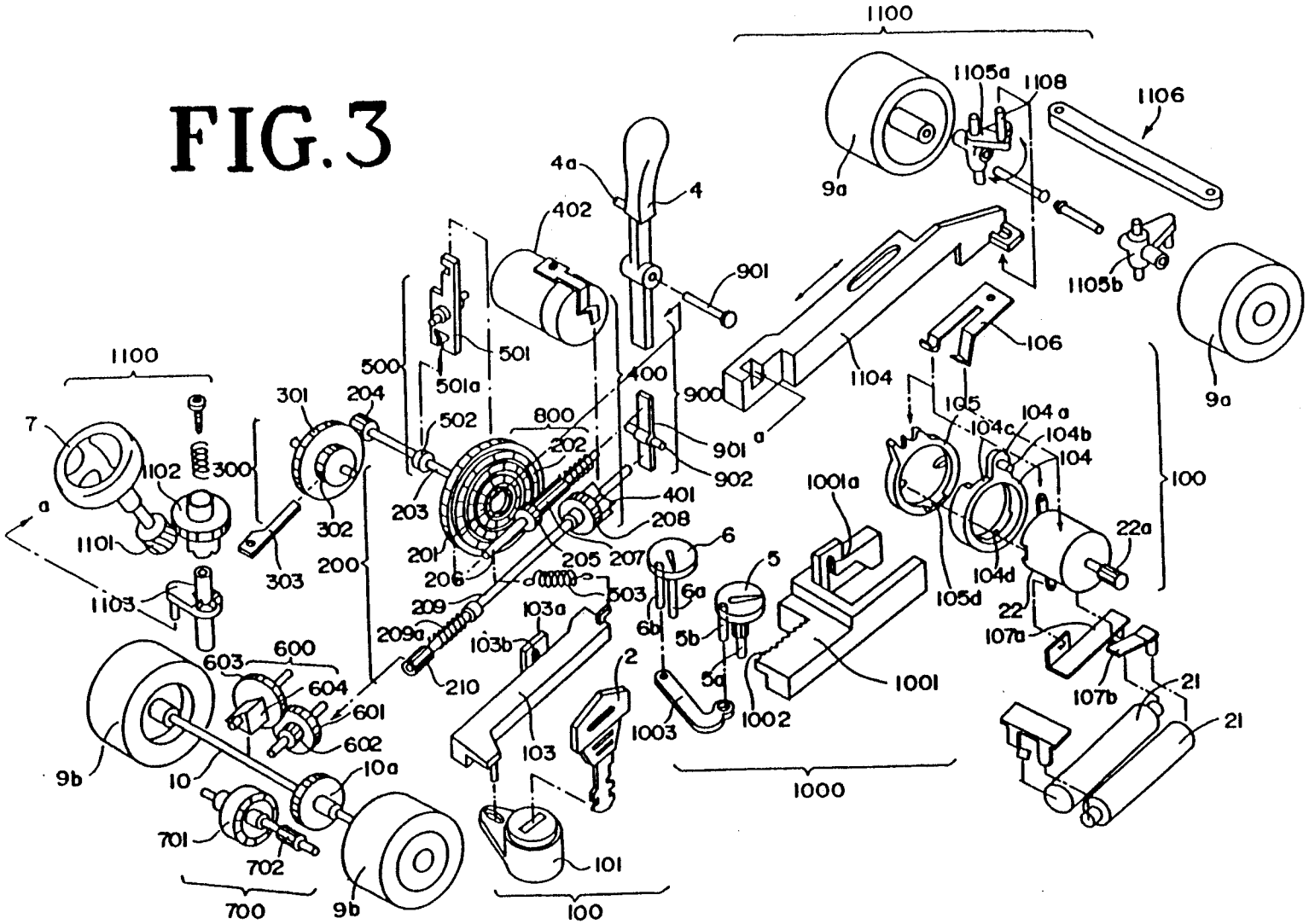
FIG. 3 is a fragmentary perspective view of an internal mechanism of a car body.

Further, batteries 21 serving as a power source, a motor 22 and various mechanisms are provided in the car body 3 as shown in FIG. 3. Included in such various mechanisms are a switch mechanism 100, a power mechanism 200, a starting sound generating mechanism 300, an engine sound generating mechanism 300, a sound switching mechanism 500, a car body rocking mechanism 600, a motion mechanism 700, an engine sound height mechanism 800, a rocking/running switching mechanism 900, an indicating mechanism 1000 and a steering direction mechanism 1100.

Figure 4:
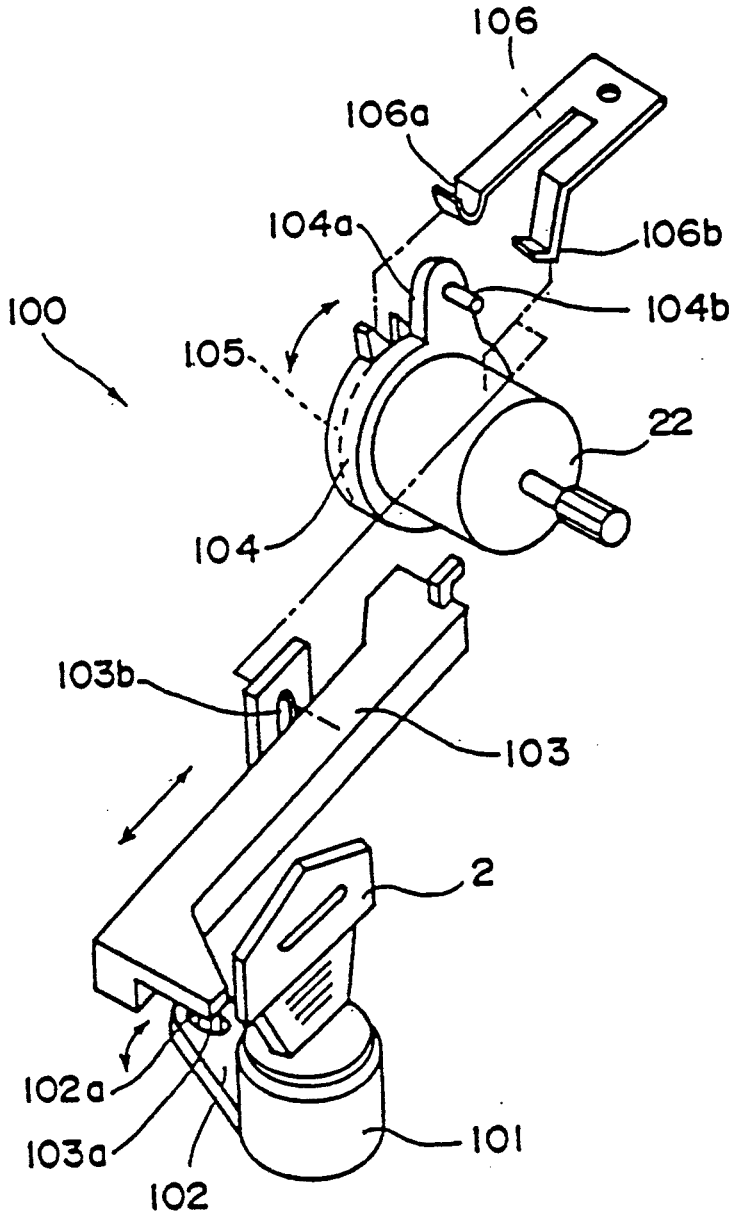
FIG. 4 is a fragmentary perspective view of a switch mechanism.

The switch mechanism 100 turns on and off motor 22 as shown in FIGS. 3 and 4. The switch mechanism 100 comprises a key drum 101 which is turned by the switch key 2, a slider 103 which is moved back and forth in the car body 3 by a turning movement of the key drum 101, a starting ring 104 for effecting connection or disconnection between the motor 22 and the batteries 21 by back and forth movement of the slider 103, a follower ring 105, and a connecting piece 106.

Figure 6:
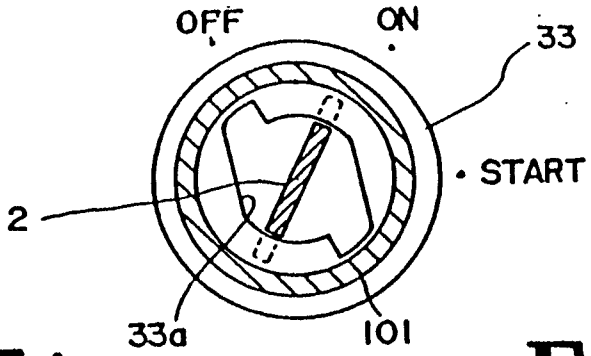
FIG. 6 is a transverse sectional view of a key drum.
Figure 7B:
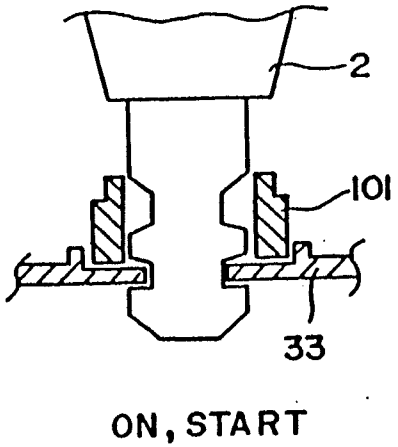
FIGS. 7(A) and 7(B) are vertical sectional views illustrating a relationship among a switch key, the switch drum and a machine frame.
Figure 7A:
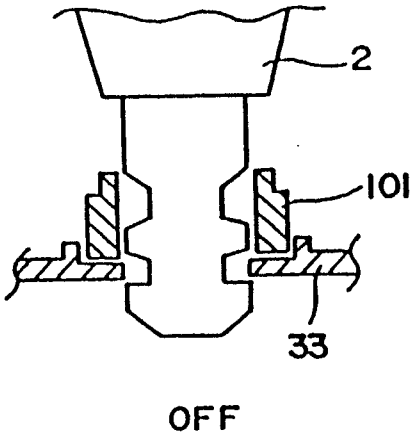

The key drum 101 is installed on the upper side of the machine frame 33 so that it may rotate around on its own axis. The switch key 2 can be inserted into or removed from the key drum 101 only when the drum 101 is at its off position (refer to the plan view of FIG. 5). In short, the machine frame 33 has an opening 33a formed therein such that, as shown in a transverse sectional view of FIG. 6, it has such a large diameter as to allow an end portion of the switch key 2 to be accepted at the off position but has such a small diameter as to disable such acceptance of the end portion of the switch key 2 at any other position. Accordingly, at the off position of the key drum 101, insertion or removal of the switch key 2 is permitted as shown in FIG. 7(A), while at the on and starting positions of the key drum 101, insertion and removal of the switch key 2 is disabled as shown in FIG. 7(B).

Figure 5:
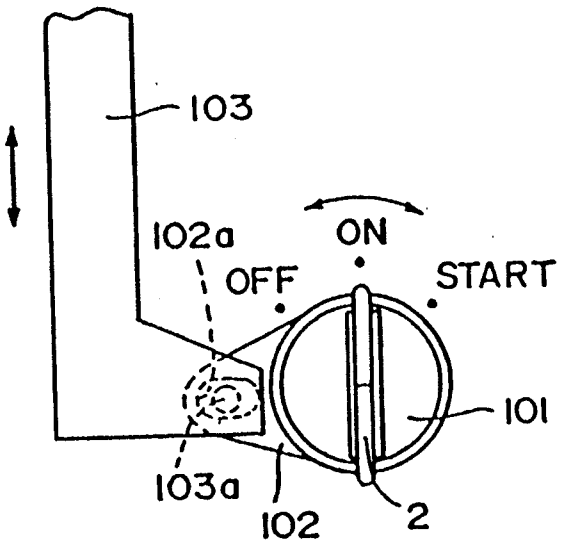
FIG. 5 is a plan view in the neighborhood of a switch drum of the switch mechanism.

Further, a tongue piece 102 projects in a radially outward direction at a lower portion of a peripheral face of the key drum 101 as shown in FIGS. 4 and 5. An end of a pin 103a provided vertically on the lower side of a rear end portion of the slider 103 provided on the machine frame 33 is held in engagement with an elongated hole 102a perforated in the tongue piece 102. And, as the key drum 101 is turned from the off position toward the starting position integrally with the switch key 2, the slider 103 is successively moved forwardly with respect to the car body 3 (refer to FIG. 8).

Figure 8:
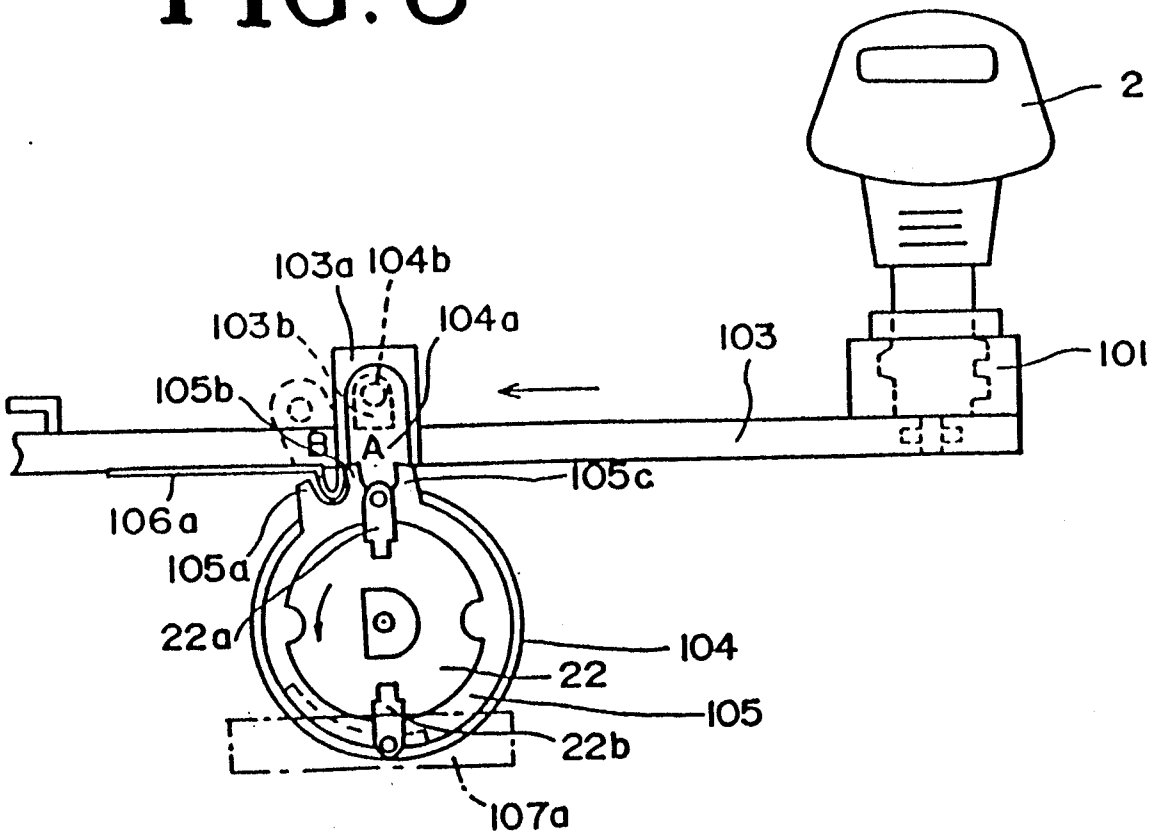
FIG. 8 is a side elevational view of the entire switch mechanism.

A projected piece 103 which is projected upwardly as shown in FIGS. 3 and 8 is provided on a side face of the slider 103. An end of a pin 104b of a tongue piece 104a provided on the starting ring 104 rotates around motor 22 and is held in engagement with an elongated hole 103b perforated in the projected piece 103a.

The starting ring 104 has a large inner diameter portion and a small inner diameter portion continuous to the large inner diameter portion. The follower ring 105 is fitted in the small inner diameter portion. Then, while the starting ring 104 and the follower ring 105 are fitted around the motor 22 in this instance, the follower ring 105 is secured to the motor 22. Positioning projections 105a, 105b and 105c of the follower ring 105 are projected in a predetermined space relationship from each other from an upper side recessed portion 104c which is provided on the large inner diameter portion of the starting ring 104 (fitting portion with the follower ring 105). A projected portion 105d is provided on a side face of the follower ring 105 and is fitted with play in a lower side recessed stepped portion 104d (refer to FIG. 3) provided on the small inner diameter portion of the starting ring 104. As a result, when the slider 103 is moved back and forth, only the starting ring 104 is turned with respect to the motor 22 or the starting ring 104. The follower ring 105 and a motor housing are turned integrally with one another. The motor 22 is turned on or off with the construction described so far.

In short, a recessed portion A on the starting ring 104 between the positioning projections 105a and 105b is present at a position corresponding to an upper side terminal piece 22a of a pair of terminal pieces 22a and 22b provided at a rear end portion of the motor 22. Meanwhile, the lower side terminal piece 22b is held in connection to a positive pole terminal plate 107a of a battery accommodating section (not shown). On the other hand, one terminal 106b of terminals 106a and 106b of the connecting piece 106 of a bifurcated profile installed on the upper side of the motor 22 is held in connection to a negative pole terminal plate 106b of the battery accommodating section (not shown) by way of a motor housing. On the other hand, the other terminal 106a of the connecting piece 106 is suitably contacted with the upper side terminal piece 22a of the motor 22 by a turning motion of the motor housing.

Figure 9:
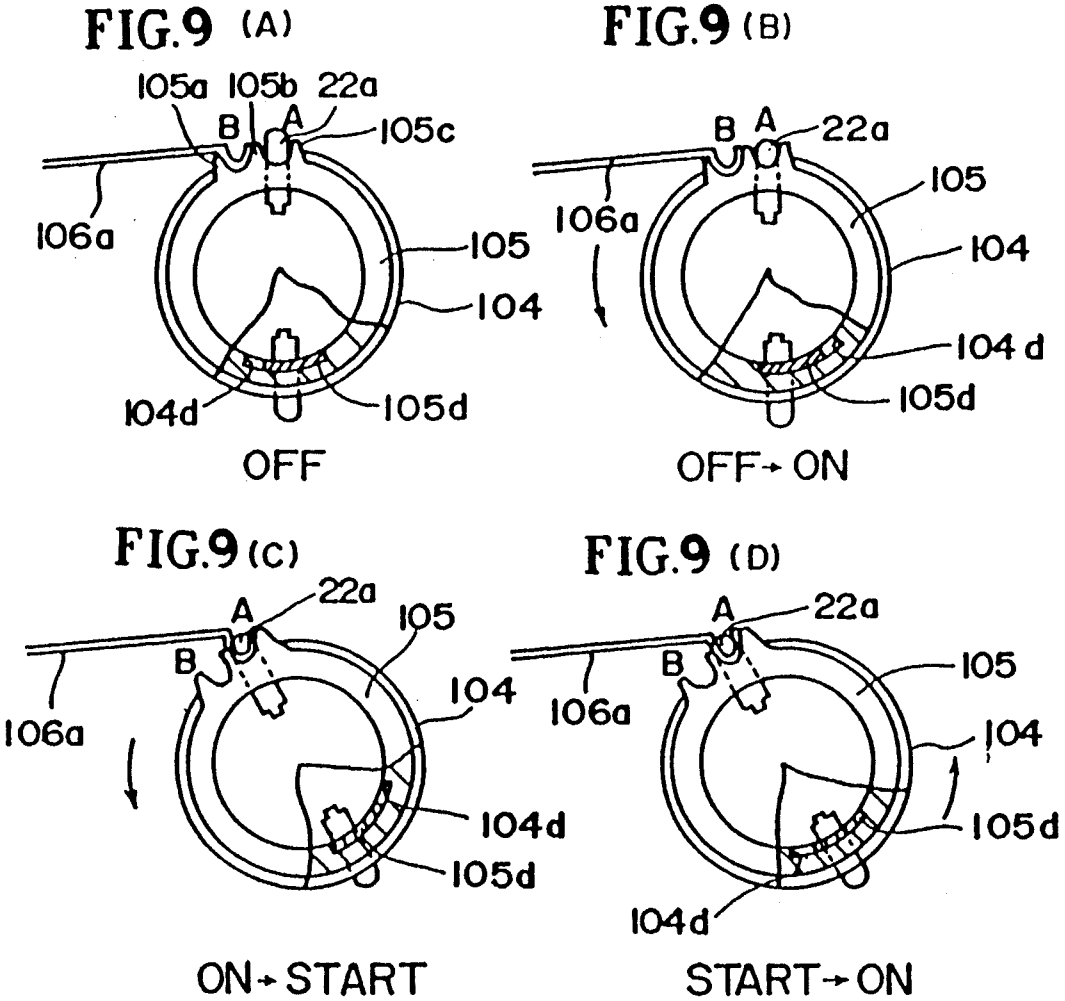
FIGS. 9(A) to 9(D) are side elevational views, partly cutaway, of a motor and in the neighborhood of the same for explanation of a principle of turning on and off of a motor.

In a condition wherein the switch key 2 is at the off position, a pawl of the terminal 106a is fitted in one recessed portion B of recessed portions A and B formed by the positioning projections 105a, 105b and 105c as shown in FIG. 9(*a*). Further, while the switch key 2 is moved from the off position to the on position, the projected portion 105d of the follower ring 105 does not make contact with an end portion of the recessed stepped portion 104d of the starting ring 104. The projected portion 105d of the follower ring 105 makes contact with the end portion of the recessed stepped portion 104d of the starting ring 104 only after the switch key 2 is moved to the on position. Only the starting ring 104 is rotated and accordingly, the follower ring 105 and the motor housing are not rotated. Then, at the on position, the pawl of the terminal 106a still remains in a fitted condition in the recessed portion B as shown in FIG. 9(B). In short, the motor 22 is not energized at the on position.

Subsequently, when the switch key 2 is moved from the on position to the starting position, since the projected portion 105d of the starting ring 105 already makes contact with an end portion of the recessed stepped portion 104d, the follower ring 105 and the motor housing are rotated by the starting ring 104. At this starting position, the pawl of the terminal 106a is fitted now into the recessed portion A as shown in FIG. 9(C). Consequently, the terminal 106a and the terminal piece 22a make contact and the motor 22 is energized. Further, while the switch key 2 is moved reversely or automatically from the starting position to the on position, the projected portion 105d of the starting ring 105 does not make contact with the end portion of the recessed stepped portion 104d of the starting ring 104. The projected portion 105d of the follower ring 105 makes contact with the end portion of the recessed stepped portion 104*d* of the starting ring 104 only after the switch key 2 is moved to the off position. When the switch key 2 is moved from the starting position to the on position, only the starting ring 104 is rotated; the follower ring 105 and the motor housing are not rotated. At the on position, the pawl of the terminal 106*a* still remains in a fitted condition in the recessed portion A as shown in FIG. 9(D). In short, at the on position in the returning stroke, the on-state of the motor 22 is maintained.

When the switch key 2 is moved from the on position to the off position, since the projected portion 105*d* of the follower ring 105 is already in a contacted condition with the end portion of the recessed stepped portion 104*d*, the follower ring 105 and the motor housing are rotated by the starting ring 104. At the off position, the pawl of the terminal 106*a* is now fitted into the recessed portion B as shown in FIG. 9(*d*). Consequently, the terminal 106*a* and the terminal piece 22*a* are disconnected from each other and the motor 22 is turned off.

The power mechanism 200 is comprised of, as shown in FIGS. 3 and 10, a gear 201 held in meshing engagement with a driving gear 22*c* of the motor 22, a ratchet gear train 202 formed on a side face of a disk which has the gear 201 formed on a peripheral face thereof, a first gear 204 provided on a multi-end side of a shaft 203 which has the disk supported at an end thereof, a second gear 205 for engaging with the ratchet gear train 202 to change the direction of turning power, a third gear 207 provided on a same shaft 206 as the second gear 205, a fourth gear 208 held in meshing engagement with the third gear 207, and a fifth gear 210 provided on a same shaft 209 as the fourth gear 208.

In the power mechanism 200, transmission of power to the starting sound generating mechanism 300 is performed by way of the first gear 204 while transmission of power to the engine sound generating mechanism 400, car body rocking mechanism 600 and running mechanism 700 is performed by way of the ratchet gear train 202. Transmission of power to the starting sound generating mechanism 300 and transmission of power to the engine sound generating mechanism 400 are performed alternatively by the sound switching mechanism 500. If the sound switching mechanism 500 is in an initial condition (off position), the ratchet gear train 202 is held in meshing engagement with the gear 205 by an action of a spring (not shown). In other words, the first gear 204 does not connect to the starting sound generating mechanism 300.

The starting sound generating mechanism 300 is comprised of, as shown in FIGS. 3 and 10, a large diameter gear 301 for meshing with the first gear 204 of the power mechanism 200, a small diameter gear 302 adapted to rotate integrally with the large diameter gear 301, and a sound generating tongue 303 having an end for contacting with the small diameter gear 302. And, in the starting sound generating mechanism 300, when the sound switching mechanism 500 operates (operates at the starting position) so that the large diameter gear 301 is brought into meshing engagement with the first gear 204, a starting sound similar to a self starter sound is generated by a scrubbing operation between the small diameter gear 302 and the sound generating tongue 303 when the gear 302 rotates.

The engine sound generating mechanism 400 is comprised of, as shown in FIGS. 3 and 10, a blade wheel 401 securely mounted on the shaft 209 of the power mechanism 200, and a drum 402 for generating an engine sound when the blade wheel 401 is rotated. The drum 402, is comprised of, though not particularly limited to, a tubular body 402*a* covered with a rubber cap 402*b*. A vibrating piece 402*c* is mounted on the drum 402, and an end of the vibrating piece 402*c* of the vibrating piece 402*c* contacts with a blade of the blade wheel 401.

In the engine sound generating mechanism 400, when the shaft 209 of the power mechanism 200 is rotated at the on position, the vibrating piece 402*c* is vibrated upon rotation of the blade wheel 401, and the rubber cap is hit by such vibrations to generate an engine sound.

The sound switching mechanism 500 comprises a rocking lever 501 as shown in FIGS. 3 and 11. The rocking lever 501 is supported for pivotal motion at its middle portion, and a convex portion 502 provided on the shaft 203 of the power mechanism 200 engages a recessed portion 501*a* provided at a lower end of the rocking lever 501. Meanwhile, a spring 503 extends between an upper end of the rocking lever 501 and an end of the slider 103 which comprises the switch mechanism 100 described above. When the slider 103 is moved to the starting position, the first gear 204 of the power mechanism 200 engages the large diameter gear 301 of the starting sound generating mechanism 300.

The rocking mechanism 600 is comprised of, as shown in FIGS. 3 and 10, a large diameter gear 601 for meshing with the gear 210 at the extremity of the power mechanism 200, a small diameter gear 602 which rotates integrally with the large diameter gear 602, and a prism-shaped cam 604 which rotates integrally with the gear 603. A prism-shaped cam 604 is held in contact with the axle 10 at a position a little leftwardly of the car body 3. Then, in the rocking mechanism 600, the car body 3 can be rocked with respect to the axle 10 by rotation of the prism-shaped cam 604.

Figure 14:
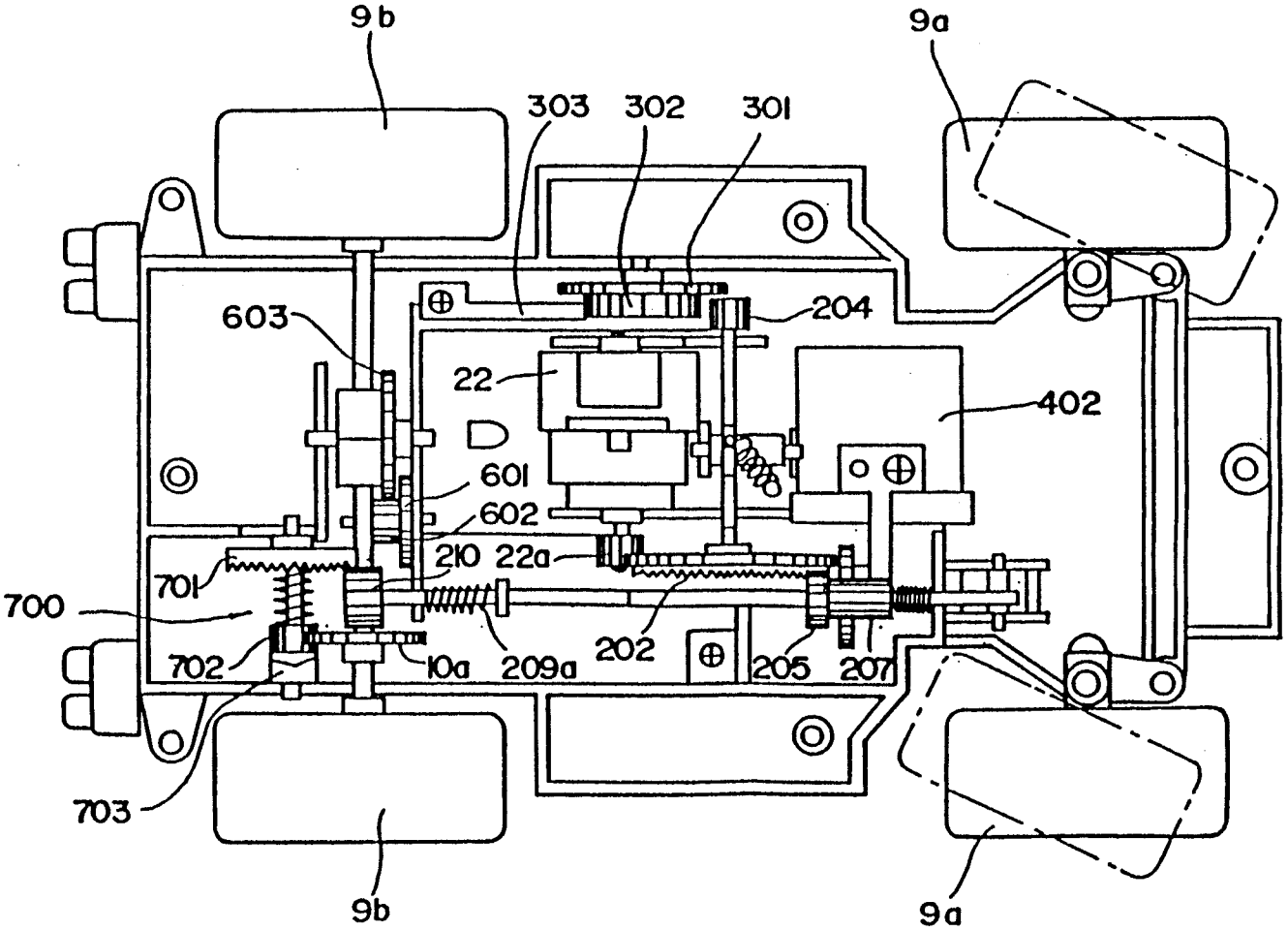
FIG. 14 is a transverse sectional view of the toy.

The running mechanism 700 is comprised of, as shown in FIGS. 3 and 10, a crown 701 for meshing with the gear 210 at the extremity of the power mechanism 200 to change the direction of turning power and a gear 702 which rotates integrally with the crown 701, and the gear 702 which is held in meshing engagement with a gear 10*a* secured to the axle 10. In the running mechanism 700, as the crown 701 is rotated by the power mechanism 200, it is possible to move the toy 1. A clutch 703 is mounted coaxially with the crown 701 and the gear 702 of the running mechanism 700 as shown in FIG. 14, so that protection of the crown 701 upon reverse rotation of the rear wheels 9*b* may be achieved.

Figure 12:
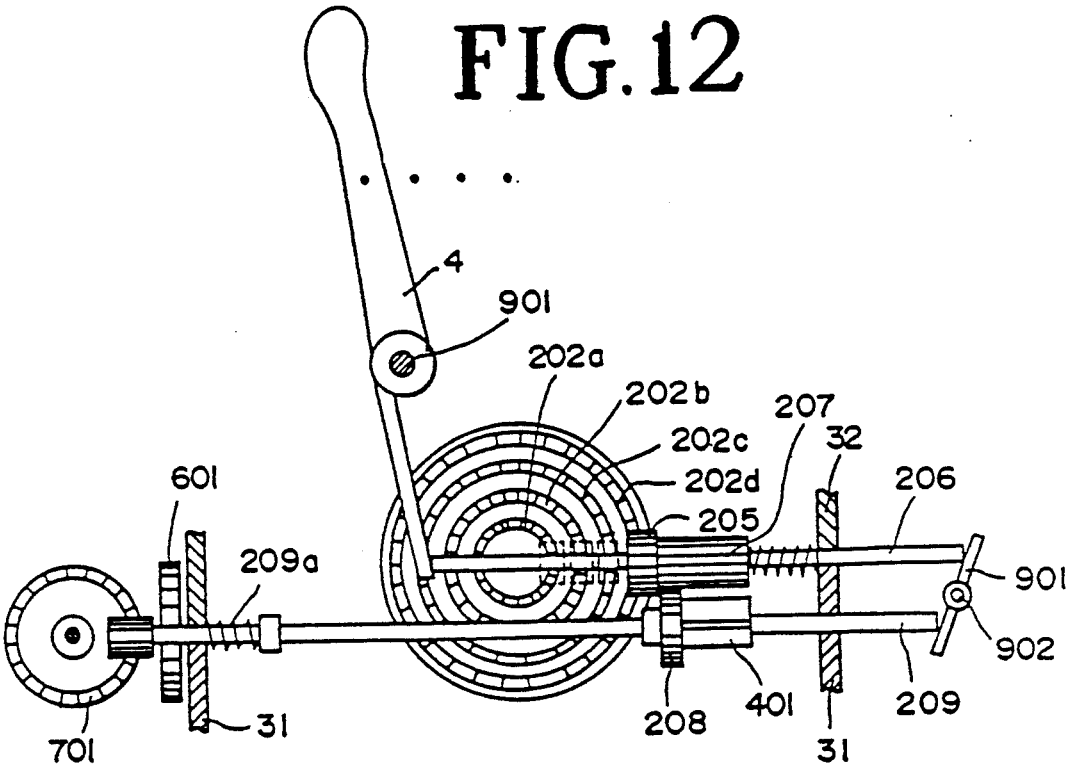
FIG. 12 is a side elevational view of an engine sound height mechanism and a rocking/running mechanism.
Figure 13:
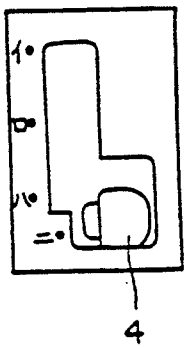
FIG. 13 is a plan view for explaining a shifting operation by a shift lever.

The engine sound height mechanism is shown in FIG. 3. The engine sound height mechanism 800 in response to a shifting operation of the shift lever 4, controls the meshing relationship of ratchet gears 202*a*, 202*b*, 202*c* and 202*d* with the second gear 205 of the power mechanism 200 to change the height of an engine sound. In short, if the position of the shift lever 4 is successively shifted from the position (a) to the positions (b), (c) and (d) as shown in FIGS. 12 and 13, then the shift lever 4 is rotated around shaft 901 to successively push the shaft 209 forwardly of the car body 3. The gear 205 which meshes with the ratchet gear 202*a* is successively meshed with and switched to the ratchet gears 202*b*, 202*c*, and 202*d*. In this instance, since the speed of rotation of the motor 22 is constant, the speed of rotation of the gear 205 and hence of the blade wheel 401 is increased in the order of the ratchet gears 202*a*, 202*b*, 202*c* and 202*d*. Also the frequency in which the drum 402 is hit is increased so that the engine sound is changed successively to higher sounds.

Meanwhile, as shown in FIG. 3, the rocking/running switching mechanism 900 rocks, by way of movement of the shaft 206 caused by a shifting operation of the shift lever 4. The rocking plate 901 around the shaft 902 connects the power mechanism 100, which is normally connected to the rocking mechanism 600 by the spring 209*a*, to the running mechanism 700 as shown in FIGS. 12 and 14.

Connection between the power transmitting mechanism 100 and the running mechanism 700 is performed only when the position of the shift lever 4 is at (d). When the shift lever 4 is at any other position, the power mechanism 200 is connected to the rocking mechanism 600.

The indicating mechanism 1000 (refer to FIG. 3) has a slider 1001 for engaging at an elongated hole 1001*a* a pin 4*a* provided on the shift lever 4. When the slider 1001 is moved in the forward or backward direction of the car body 3 on the machine frame 33 by a shifting operation of the shift lever 4, a tachometer shaft 5*a* held in meshing engagement with a rack 1002 formed on a side face of the slider 1001 is rotated; and further, the speedometer 6 is rotated around the shaft 6*a* by way of a link 1003 which is engaged at the opposite ends with a pin 5*b* positioned vertically on the lower side of the tachometer 5 and another pin 6*b* positioned vertically on the lower side of the speedometer 6.

Figure 15:
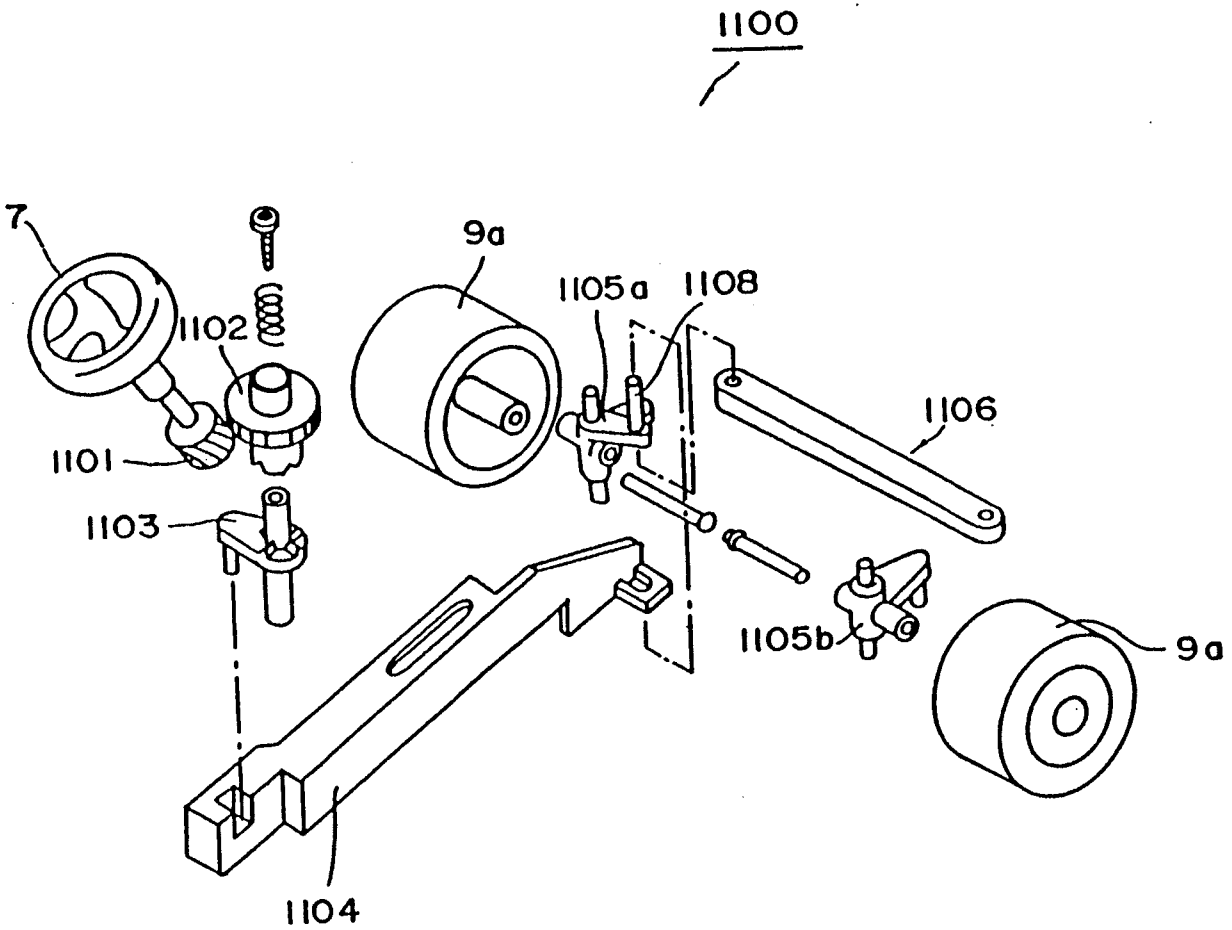
FIG. 15 is a fragmentary perspective view of a running direction mechanism.

In the steering direction mechanism 1100, as shown in FIGS. 3 and 15, a steering wheel 7 is rotated around a vertical axis by a gear 1102 through a spiral gear 1101 provided at a lower end portion of a shaft 7*a* of the steering wheel 7. This rotation is further changed by a movement in the forward or backward movement of a slider 1104 controlled by a rocking plate 1103. Then, such movement in the forward or backward direction of the slider 1104 is changed into a turning movement of a support shaft 1105*a* for the left-hand side front wheel 9*a* and further changed into turning motion of the right-hand side front wheel 9*a* through a support shaft 1105*a* by a tie rod 1106.

Figure 16:
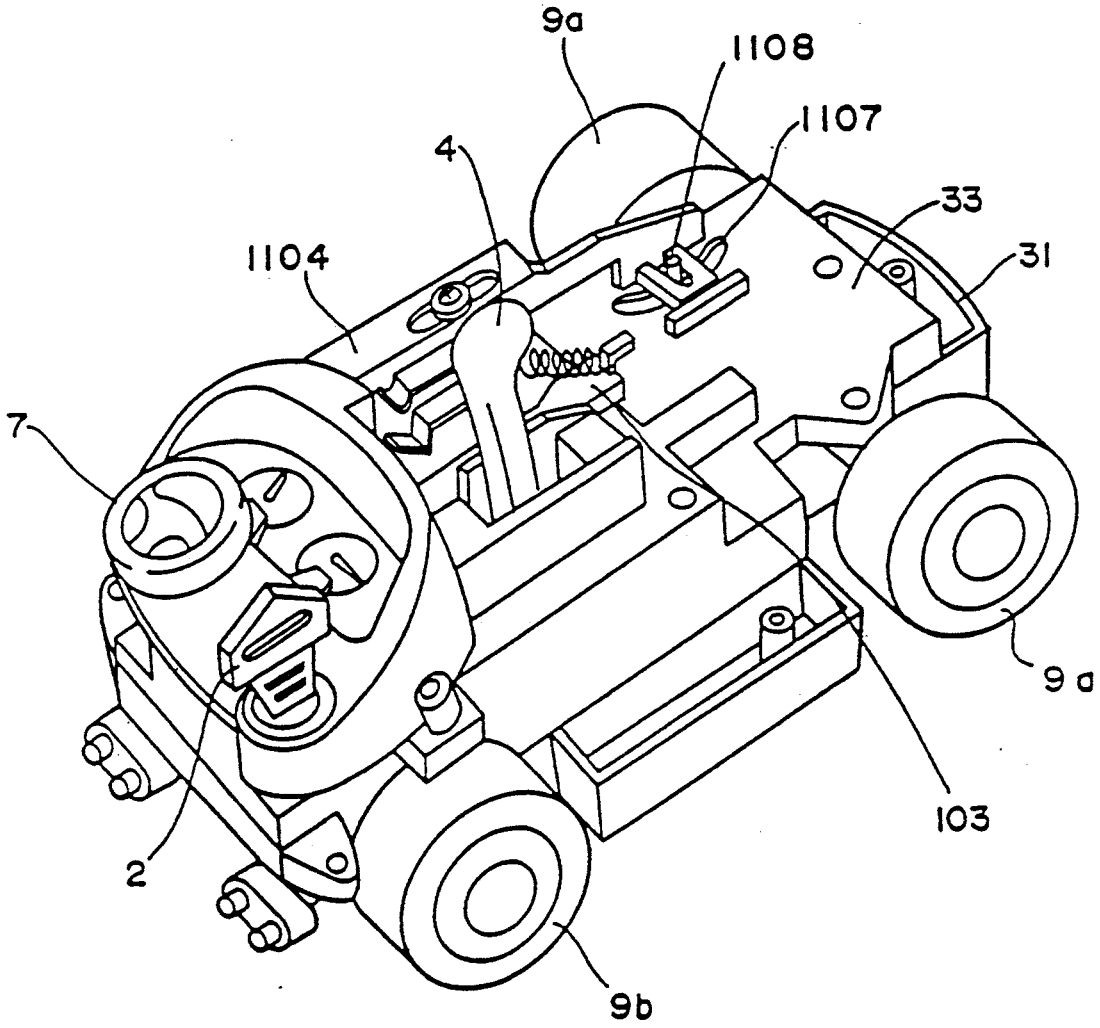
FIG. 16 is a perspective view showing a condition wherein a cover of the car body is removed.

The changing a movement of the slider 1104 in the forward or backward direction into a turning movement of the support shaft 1105*a* of the left-hand side front wheel 9*a* is performed through a crescent-shaped hole 1107 as shown in FIG. 16. Accordingly, the front wheel 9*a* once changed in direction by the steering wheel 7 will maintain their direction until the steering wheel 7 is rotated subsequently.

The toy is rendered operative when the switch key 2 is turned to the starting position, and thereupon, a starting sound is generated. Meanwhile, when the switch key 2 comes to the on position, an engine sound is generated.

Since the height of an engine sound is varied by a shifting operation of the shift lever 4 and a rocking motion of the car body 3 takes place before running, a feeling of realism is further improved. Further, since the running toy cannot be driven without using the switch key 2, consciousness of possession of the toy can be promoted.

The present invention is not limited to the foregoing embodiment and various modifications can be made thereto without departing from the scope and spirit of the invention.

For example, while an automobile toy is shown as the embodiment described above, naturally it may also be a ship, a truck, a fire engine, train, an airplane or other vehicle.

The starting ring 104 and the follower ring 105 are included in the embodiment described above as components of the switch mechanism 100 to allow the switch mechanism 100 to be turned on only at the starting position and maintain an on-state at the on position in the return stroke. A structure can also be made so that the switch mechanism 100 is turned on only at the on position and can maintain the on condition. This eliminates the need for the starting position and does not limit the present invention to the starting ring 104 and the follower ring 105.

If the key switch only has two positions, on and off, the present invention could also be constructed so that a starting sound is generated during a first period of time and then the engine sound is generated after the first period of time. This structure would only require a delay circuit.

The rocking of the car as disclosed occurs in an up and down manner, but this invention could also be made using a motion which goes left and right.

What is claimed is:

1. A key action, movable toy having a body, comprising:

power means for moving the toy and for keeping the toy stationary vibrating means for bouncing the body of the toy up and down;

means for generating an engine starting sound;

means for generating an engine running sound;

key switch means, operatively connected to said means for generating an engine starting sound and said means for generating an engine running sound, having an off position, a starting position and an on position, said means for generating an engine starting sound generating the engine starting sound when said key switch means is in the starting position, said means for generating an engine running sound generating the engine running sound when said key switch means is in the on position, and ceasing to generate the engine running sound when said key switch means returns to the off position, said power means operative to move the toy when said key switch means is in the on position, and said vibrating means operative to vibrate the toy body up and down when the toy is stationary and said key switch means is in the on position.

2. A key action, movable toy having a body, comprising:

power means for moving the toy and for keeping the toy stationary;

vibrating means for rolling the body of the toy left and right;

means for generating an engine starting sound;

means for generating an engine running sound;

key switch means, operatively connected to said means for generating an engine starting sound and said means for generating an engine running sound, having an off position, a starting position and an on position, said means for generating an engine starting sound generating the starting sound when said key switch means is in the starting position, said means for generating an engine running sound generating the engine running sound when said key switch means is in the on position, and ceasing to generate the engine running sound when said key switch means returns to the off position, said power means operative to move the toy when said key switch means is in the on position, and said vibrating means operative to vibrate the toy body left and right when the toy is stationary and said key switch means is in the on position.

* * * * *